United States Patent [19]

Lange

[11] 3,962,105

[45] June 8, 1976

[54] LUBRICATING COMPOSITIONS

[75] Inventor: Richard Michael Lange, Euclid, Ohio

[73] Assignee: The Lubrizol Corporation, Cleveland, Ohio

[22] Filed: Mar. 25, 1975

[21] Appl. No.: 561,963

[52] U.S. Cl. ..... 252/56 R; 252/72

[51] Int. Cl.[2] ..... C10M 1/24; C10M 3/18; C10M 5/12; C10M 7/20

[58] Field of Search ..... 252/56 R, 72

[56] References Cited

UNITED STATES PATENTS 3,813,416 5/1974 Heiba et al. ..... 252/56 R 3,849,473 11/1974 Inamoto et al. ..... 252/56 R

FOREIGN PATENTS OR APPLICATIONS 882,688 11/1961 United Kingdom ..... 252/56 R

*Primary Examiner*—Delbert E. Gantz
*Assistant Examiner*—I. Vaughn
*Attorney, Agent, or Firm*—James W. Adams, Jr.; Edmund C. Ross, Jr.

[57] ABSTRACT

Lubricating compositions containing seal swelling additives based upon certain diesters and/or ester lactones are disclosed.

15 Claims, No Drawings

LUBRICATING COMPOSITIONS

The invention herein is concerned with lubricating compositions comprising a novel additive that will improve the seal-swelling properties of the compositions. The invention is also concerned with additive concentrates comprising the subject seal-swelling additives.

Many lubricating compositions are designed to be used in systems whereby they are continually in contact with various non-metallic sealing materials, such as seals, gaskets, packing, etc. During ordinary usuage, these sealing materials may deteriorate and lose their effectiveness to prevent leakage of lubricant fluids around the sealing material. Lubricant compositions containing the subject novel additives have the ability to swell and maintain the sealing material in a soft, pliable condition, whereby they are continually effective in preventing the leakage of fluids.

The additives of the present invention are effective in lubricating compositions based upon both natural and synthetic oils of lubricating viscosity. Likewise, these additives are effective in lubricating compositions containing additional additives.

The subject additives can be effectively employed in a variety of lubricating compositions formulated for a variety of uses. Thus, lubricating compositions containing these additives are effective, primarily, as automatic and manual transmission fluids, hydraulic fluids, hydrostatic transmission fluids, transaxle fluids, power steering fluids, hypoid gear lubricants, and power transmission fluids.

The lubricating compositions of the present invention comprise a major proportion of lubricating oil and a minor effective proportion, sufficient to improve the seal swelling properties of the additive. In general, the subject seal swelling additives are used in amounts of from about 0.01% to about 20% by weight of the total weight of the lubricating composition. The optimum concentration for a particular additive will depend to a large measure upon the type of service the composition is designed for. In most applications, lubricating compositions containing from about 0.1% to about 10% by weight of the subject additive are useful, although for certain applications compositions containing up to 20% or more may be preferred.

The seal swelling additives of the subject lubricating compositions are selected from the group consisting of those corresponding to the formulae:

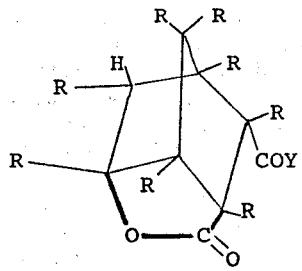

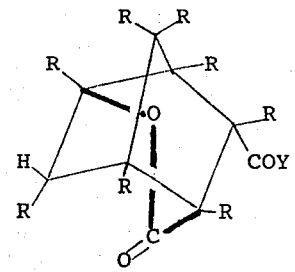

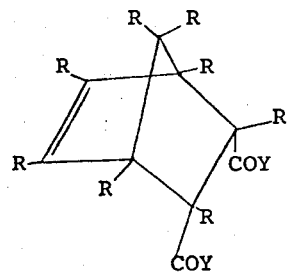

and mixtures thereof, wherein each R is independently selected from the group consisting of hydrogen and lower alkyl, with the provision that no more than two R's per molecule are lower alkyl, and each Y contains up to about twenty-two carbon atoms, and is independently selected from the group consisting of hydrocarbon-based oxy radicals and the oxy residue of a polyhydric alcohol.

Thus, the additives of the present invention are based upon three types of compounds depending upon their particular ring structure:

I. Esters derived from 5-hydroxybicyclo[2·2·1]-heptane-2,3-dicarboxylic acid 3,5-lactone, hereinafter referred to as esters of the 3,5-lactone; or esters derived from mono- or di- lower alkyl substituted 5-hyroxybicyclo[2·2·1]heptane-2,3-dicarboxylic acid, 3,5-lactone hereinafter referred to as esters of the mono- or di-substituted 3,5-lactone.

II. Esters derived from 5-hydroxybicyclo[2·2·1]heptane-2,3-dicarboxylic acid 2,5-lactone, hereinafter referred to as esters of the 2,5-lactone; or ester derived from mono- or di- lower alkyl substituted 5-hydroxybicyclo[2·2·1]heptane-2,3-dicarboxylic acid, 2,5-lactone hereinafter referred to as esters of the mono- or di-substituted 2,5-lactone.

III. Diesters derived from bicyclo[2·2·1]hept-5-ene-2,3-dicarboxylic acid, hereinafter referred to as the diesters of the 2,3-diacid; or diesters derived from mono- or di- lower alkyl substituted bicyclo[2·2·1-]hept-5-ene-2,3-dicarboxylic acid hereinafter referred to as the diesters of the mono- or di- substituted 2,3-diacid.

While additives based on any of the above-described three types of esters are effective as seal swelling additives, as a practical matter, the seal swelling additives of the present invention are, for the most part, based upon various mixtures of each of the three type compounds. These mixtures are obtained during the course of the preparation of the esters of the 3,5-lactones.

The additives of the present invention are based upon compounds which are known in the art. Thus, U.S. Pat. No. 2,459,684 issued to Croxall and Neher, describes the preparation of the ester lactones of the present invention. Their method for the preparation of the ester lactones is by the treatment of a mono ester of a bicyclo[2·2·1]hept-5-ene-2,3-dicarboxylic acid with a trace of water and a strong acid such as sulfuric acid. Disclosed mono esters suitable for use in the preparation of the ester lactones are derived from mono- or polyhydric alcohols. These alcohols include, for example, butyl alcohol, octyl alcohol, benzyl alcohol, phenoxyethyl alcohol, methoxyethoxyethyl alcohol, propylene glycol, sorbitol and mannitol. The starting dicarboxylic acid or anhydride useful in the preparation of the ester lactones or diesters of the present invention are conveniently obtained by a Diels-Alder type addition of the appropriate maleic anhydride to the appropriate cyclopentadiene. The Croxall et al patent is expressly incorporated herein for its disclosure of suitable methods for the preparation and identification of the ester lactones and other information concerning them.

In addition to the preparative method disclosed by Croxall et al, other methods may be used to prepare the seal swelling additives of the present invention. For example, the anhydride may first be hydrolyzed to the diacid, the diacid monoesterified, and then lactonized. Or, the diacid may first be lactonized and then esterified. These alternative preparative methods will be exemplified hereinafter.

In addition to the sulfuric acid disclosed in the above discussed reference, other strong acids are effective in the lactonization step. Thus, strong acids such as $BF_3$, $BF_3$· etherate, p-toluene sulfonic acid and methane sulfonic acid may be employed in this step. Useful concentrations of the strong acid in the lactonization step are in the range of from about 0.02 mole to about 1.0 mole per mole of the lactonizable material.

Water is added in the lactonization step to facilitate the acid catalyzed cyclization to the lactone. Useful concentrations of water in this step are in the range of from about 0.002 mole to about 1.0 mole per mole of lactonizable material.

The reaction temperature for the lactonization step should be high enough to promote a reasonable reaction rate but not so high as to cause reactant or product decomposition. A useful temperature range is from about 50°C. to about 175°C. A preferred temperature range is from about 70°C. to about 150°C. As a practical matter, since solvents such as those disclosed in the Croxall et al patent are used in this step, the reaction is conducted at about reflux temperature and the excess water separated by azeotropic distillation.

As was mentioned above, while any of the three types of ester additives are effective as seal swelling additives for lubricating compositions as a practical matter, mixtures of these are usually used. During the preparative process, several competitive reactions occur with the net result being a mixture of final products. For example, during the preparation of the esters of the 3,5-lactone or esters of the substituted 3,5-lactone, minor amounts of the esters of the corresponding 2,5-lactone, minor and diesters of the corresponding, 2,5-diacid are formed. While these minor amounts of by-products could be separated from the esters of the 3,5-lactone, the present economics involved is such that a separation step is unattractive.

The terminology of "hydrocarbon-based oxy" or "hydrocarbon-based oxy radical" as used herein and in the appended claims is used to define a substantially saturated monovalent radical derived from a hydrocarbon by the replacement of a hydrogen atom from a carbon atom of the hydrocarbon by an oxy group (-O-). These hydrocarbon-based oxy radicals are derived from aliphatic hydrocarbons, cyclo-aliphatic hydrocarbons, aromatic hydrocarbons, mixed aliphatic-cycloaliphatic hydrocarbons, mixed aliphatic-aromatic hydrocarbons, and mixed cycloaliphatic-aromatic hydrocarbons. As is discussed more fully below, the base hydrocarbons from which these radicals are derived, may contain certain polar substituents. Thus, the "hydrocarbon-based oxy" terminology is a generic expression for (1) hydrocarbyloxy and (2) substituted hydrocarbyloxy radicals.

The terminology "substantially saturated" as used herein is intended to define radicals free from acetylenic unsaturation (—C C—) and in which there is not more than one (1) ethylenic linkage (—C=C—) for every eight (8) carbon-to-carbon covalent bonds. The so-called "double bonds" in aromatic rings (e.g., benzene) are not to be considered as contributing to unsaturation with respect to the terminology "substantially saturated". Usually there will be no more than an average of one (1) ethylenic linkage per substantially saturated monovalent radical as described hereinbefore. Preferably (with the exception of aromatic rings), all the carbon-to-carbon bonds in a substantially saturated radical will be saturated linkages; that is, the radical will be free from acetylenic and ethylenic linkages.

In general, the hydrocarbon-based oxy radicals may contain up to about thirty (30) carbon atoms with a preferred range of carbon atoms being from 1 up to about. The subject radicals may contain certain non-reactive polar or non-hydrocarbon substituents. As a general rule, and particularly, when the compounds of this invention are to be used as lubricant additives, the degree of substitution and nature of the substituent on the hydrocarbon-based oxy radicals is such that the essentially hydrocarbon character of the radical is not destroyed. Thus, in view of this requirement, these substituted radicals normally, have no more than four substituents per radical, and usually, not more than one substituent for every carbon atoms.

As used herein and in the appended claims, the terminology "hydrocarbyloxy" is used to define those radicals containing no polar or non-hydrocarbon substituent derived from the above described hydrocarbon-based oxy radicals. Similarly, the terminology "substituted hydrocarbyloxy" is used to define those radicals containing a polar or non-hydrocarbon substituent derived from the above described radicals. Thus, the following are representative examples of hydrocarbyloxy radicals:

1. alkoxy, such as ethoxy, t-butoxy, isooctyloxy, dodecyloxy and eicosyloxy;
2. alkenyloxy, such as allyloxy, 2-pentenyloxy, and dodecenyloxy;
3. cycloalkoxy, such as cyclooctyloxy and cyclobutyloxy;
4. cycloalkenyloxy, such as cyclopentenyloxy and cycloheptenyloxy;

5. aryloxy, such as phenoxy, naphthyloxy and diphenyloxy;
6. cycloalkylalkoxy, such as cyclopropylethoxy and cyclooctylbutoxy;
7. cycloalkenylalkoxy, such as cyclohexenylpropoxy and cyclopentenylmethoxy;
8. arylalkoxy, such as benzyloxy, phenylethoxy, tolyldecyloxy and naphthlethoxy;
9. arylalkenyloxy, such as phenylvinyleneoxy and 2-xylylallyloxy;
10. alkylcycloalkyloxy, such as trimethylcyclododecyloxy and butylcycloheptyloxy;
11. alkenylcycloalkyloxy, such as vinylcyclopentyloxy and butenylcyclooctyloxy;
12. alkylcycloalkenyloxy, such as butylcyclohexenyloxy and methylcyclooctenyloxy;
13. alkenylcycloalkenyl, such as vinylcyclopentenyloxy and butenylcycloheptenyl;
14. arylcycloalkyloxy, such as xylylcyclodecyloxy and naphthylcyclohexyloxy;
15. arylcycloalkenyloxy, such as phenylcyclohexenyloxy and tolylcyclododecenyloxy;
16. alkylaryl, such as tolyloxy, xylyloxy, dodecylphenoxy and didodecylphenoxy;
17. alkenylaryloxy, such as allylphenoxy, octenylphenoxy and 4(2-butenyl)phenoxy;
18. cycloalkylaryloxy, such as cyclobutylphenoxy and cyclohexylnaphthyloxy;
19. cycloalkenylaryloxy, such as cyclopentenylphenoxy and cyclohexenylphenoxy.

When a named radical has several isomeric forms, all such forms are included.

The preferred hydrocarbyloxy radicals are those selected from the group consisting of alkoxy, phenoxy, naphthyloxy, alkylphenoxy, alkylnaphthyloxy, phenylalkoxy, naphthylalkoxy, alkylphenylalkoxy and alkylnaphthylalkoxy. The most preferred hydrocarbyloxy radicals are alkoxy, phenoxy, alkylphenoxy, phenylalkoxy and alkylphenylalkoxy.

The terminology of "lower alkyl" as used herein and in the appended claims is used within the commonly accepted meaning in the art. Thus, lower alkyl refers to a straight or branched chain alkyl radical or group containing up to about seven carbon atoms. Accordingly, this terminology includes alkyl radicals such as methyl, ethyl, tertiarybutyl, isoamyl and n-heptyl.

Representative non-hydrocarbon or polar substituents for the substituted hydrocarbyloxy radicals include halo substituents, such as chloro, fluoro, bromo and iodo. The chloro and bromo substituents are the preferred polar substituents.

As used herein, and in the appended claims, the terminology of "oxy residue of a polyhydric alcohol" is used to define the radical or group resulting from the removal of a hydrogen from one of the hydroxyl groups of the polyhydric alcohol. The polyhydric alcohols from which the oxy residues are derived, are diverse in structure and chemical composition. Generally, they have from two to ten hydroxy groups, and have up to about 22 aliphatic carbon atoms. These polyhydric alcohols may be based upon a carbon-to-carbon chain, or they may be based upon a carbon-to-carbon chain containing hetero-atom interrupters or enchained hetero-atoms such as oxa(—O—) or thia(—S—). Typical polyhydric alcohols of the type based upon a carbon-to-carbon chain are propylene glycol, glycerol, pentaerythritol, and mannitol. Typical polyhydric alcohols of the type based upon a hetero-atom interrupted carbon-to-carbon chain are diethylene glycol, tetraethylene glycol, and tripropylene glycol. Also, included within the scope of the above terminology is the situation wherein one or more of the hydroxy groups of the oxy residue has been etherified, or esterified, such as the methylether or propylene glycol, the methylether of glycerol, or the propionate of triethylene glycol.

Typical polyhydric alcohols useful in preparing the esterified additives of the present invention, and exemplary of the source of the oxy residue of polyhydric alcohols include alkylene glycols, such as ethylene glycol, trimethylene glycol, butylene glycol; and polyglycols such as triethylene glycol, dipropylene glycol, dibutylene glycol, tributylene glycol; and other alkylene glycols and polyalkylene glycols in which the alkylene radical contains from two to about eight carbon atoms. Other useful polyhydric alcohols include 3-chloro-1,2-propanediol, 1,2-butanediol, 1,4-butanediol, 2,3-hexanediol, erythritol, arabitol, sorbitol, 1,2-cyclohexanediol, 1,4-cyclohexanediol, and dipentaerythritol. Also useful as polyhydric alcohols are the carbohydrates such as glucose, arabinose, ramnose, mannose, and galactose.

A preferred class of polyhydric alcohols are the polyhydric alcohols containing three to ten, especially three to six carbon atoms. Such alcohols are exemplified by glycerol, 2-hydroxymethyl-2-methyl-1,3-propanediol (trimethylolethane), 2-hydroxymethyl-2-ethyl-1,3-propanediol(trimethylolpropane), 1,2,4-butanetriol, 1,2,6-hexanetriol, 1,2,3,-pentanetriol, 1,2,3-hexanetriol, 1,2,4-hexanetriol, 1,2,5-hexanetriol, 2,3,4-hexanetriol, mannitol, pentaerythritol, and sorbitol.

Typical monohydric alcohols useful in preparing the additives of the present invention and exemplary of the source of the preferred alkoxy groups include propanol, decanol, butanol, nonanol, pentanol, octanol, hexanol and heptanol. Mixtures of these alcohols may be used, such as $C_8$-$C_{10}$ Oxo alcohols, and mixtures of primary amyl and isobutyl alcohols.

A clearer understanding of the additives of the present invention, and lubricating compositions containing these additives may be obtained from the examples given below, which illustrate the presently preferred best modes of carrying out this invention.

EXAMPLE 1

A solution of bicyclo[2·2·1]hept-5-ene-2,3-dicarboxylic anhydride in toluene is prepared by reacting 1960 grams (20 moles) of maleic anhydride dissolved in 3000 grams of toluene with 1320 grams (20 moles) of cyclopentadiene at a reaction temperature in the range of from about 70° to 75°C.

The toluene solution of the anhydride is treated with 4108 grams (26 moles) of decanol, followed by 237.5 grams (1.25 moles) of p-toluenesulfonic acid and 23.5 grams (1.25 moles) of water. The mixture is slowly heated to reflux temperature and held there for about 5 hours. During the latter three hours of refluxing, approximately 120 ml. of water is removed by azeotropic distillation.

After refluxing, the reaction mixture is cooled to 60°C. and 30 grams (1.76 moles) of ammonia gas is introduced into the reaction mixture through a gas sparging tube immersed in the reaction mixture. The neutralized reaction mixture is cooled to about 30°–35°C. and filtered. The filtrate is vacuum stripped to give 6220 grams of a clear liquid ester lactone product.

EXAMPLE 2

Bicyclo[2·2·1]hept-5-ene-2,3-dicarboxylic anhydride (820 grams, 5.0 moles) and 392.2 grams (5.3 moles) of n-butanol are charged to a reactor, heated to reflux temperature (140°–150°C.) and this reaction temperature is maintained for about 6 hours. The reaction mixture is cooled to about 60°C. and a mixture of 51 grams of sulfuric acid and 10 grams of water is added and the temperature of the resulting mixture maintained in the range of 75°–80°C. for 1 hour. The material is then dissolved in toluene, washed with aqueous sodium bicarbonate, dried and vacuum stripped to yield 700 grams of clear fluid product.

EXAMPLE 3

Bicyclo[2·2·1]hept-5-ene-2,3-dicarboxylic anhydride (164 grams, 1 mole), 200 ml. of toluene are charged to a reactor and a mixture of 2.5 grams of water and 12.5 grams sulfuric acid (97% $H_2SO_4$) are slowly added. The temperature of the resulting mixture is increased to about 70°C. and maintained for about 3 hours. n-Butanol (81 grams, 1.1 moles) is added, the temperature of the resulting mixture increased to reflux and the evolved water collected. The resulting mixture is cooled, diluted with an additional 300 ml. of toluene, washed with aqueous sodium hydroxide, dried and the toluene separated by vacuum stripping. A clear liquid product is obtained weighing 193 grams.

EXAMPLE 4

Bicyclo[2·2·1]hept-5-ene-2,3-dicarboxylic anhydride (820 grams, 5 moles), 600 ml. of toluene and a mixture of 51 grams (0.5 mole) of 97% sulfuric acid and 10 ml. of water are charged to a reactor and heated to 80°C. After about 2 hours at this temperature, an additional 72 grams of water is added and the hydrolysis reaction is continued for an additional hour. At the end of this period, 392.2 grams (5.3 moles) of n-butanol is added to the cooled reaction mixture and the temperature increased to reflux. The reaction mixture is refluxed until about the theoretical amount of water is separated. The cooled crude reaction mixture is diluted with 500 ml. of toluene, the organic material washed with aqueous sodium hydroxide, water and saturated sodium chloride solution; dried and vacuum stripped to give 1056 grams of product.

EXAMPLE 5

Bicyclo[2·2·1]hept-5-ene-2,3-dicarboxylic anhydride (164 grams, 1 mole), 112 grams (1.1 moles) of 4-methyl-2-pentanol and 200 ml. of toluene were charged to a reactor, heated to reflux temperature and maintained at this temperature for about 2.5 hours. The mixture is cooled to about 80°C., 1 gram of triethylamine is added, the temperature is slowly increased to reflux and refluxed for about two hours. After cooling, an additional 200 ml. portion of toluene and 15 grams of 85% sulfuric acid is added. The resulting mixture is refluxed for about 30 minutes and the evolved water collected. After cooling, the reaction mixture is diluted with an additional 200 ml. portion of toluene and worked up as in Example 4. A yield of 150 grams of the ester lactone product is obtained.

EXAMPLE 6 n-Butanol (185 grams, 2.5 moles), 164 grams (1.0 mole) bicyclo[2·2·1]hept-5-ene-2,3-dicarboxylic anhydride, and 350 ml. of toluene are charged to a suitable reactor, and with stirring under nitrogen, 2.9 grams tetra(isopropoxy)titanium is added. The temperature of the reaction mixture is increased to reflux and refluxing continued for about 6 hours. After cooling to 50°C., 2.0 grams of dibutyltin diacetate is added and refluxing continued for four hours. At the end of this period, an additional 2.0 grams of dibutyltin diacetate is added and refluxing continued for an additional ten hours. After cooling, the reaction mixture is washed with water, saturated sodium chloride solution and the organic layer, after drying, vacuum stripped. This gives a 156 gram yield of the dibutyl ester of the diacid.

EXAMPLE 7

A reactor is charged with 328 grams (2.0 moles) of bicyclo[2·2·1]hept-5-ene-2,3-dicarboxylic anhydride, 300 grams of toluene, and 197.6 grams (2.6 moles) of ethylene glycol monomethyl ether and heated to a temperature of 55°–60°C. p-Toluenesulfonic acid (19 grams, 0.1 mole) and 1.8 grams of water is added and the mixture is refluxed for two hours. After insertion of a water trap in the system, refluxing is continued until about 32 ml. of water is separated. After cooling the product is worked up in the usual manner to give 392 grams of the methoxyethyl ester of the 3,5-lactone.

The lubricating compositions of the present invention may, of course, be prepared by a variety of methods known in the art. One convenient method is to add the seal swelling additive in the form of a concentrated solution or substantially stable suspension to a sufficient amount of the base lubricant to form the final subject lubricating compositions. This additive concentrate contains the seal swelling additive in the proper amount to provide the proper ratio of additive in the final lubricating composition when added to a predetermined amount of base lubricant. Also, the concentrate may contain appropriate amounts of any additional additive which is to be incorporated in the final lubricating composition.

Generally, the concentrate will comprise from about 20% to about 90% of the seal swelling additive with the balance being a substantially inert normally liquid solvent or diluent, plus any additional additives used. Suitable solvents and diluents include any of the herein discussed natural or synthetic oils, kerosene, xylene, benzene, mixtures of two or more of these and other solvents and diluents known in the art. Hereinafter, these substantially inert, normally liquid solvents and diluents used in the preparation of additive concentrates are referred to collectively as carriers. Normally the carriers are oil-soluble at least to the extent of their concentration in the final lubricating compositions prepared from them.

The seal swelling additives of the present invention are effectively employed using base oils of lubricating viscosity derived from a variety of sources. Thus, base oil derived from both natural and synthetic sources are useful for the preparation of lubricating compositions of the present invention.

The natural oils include animal oils, such as lard oil; vegetable oils, such as castor oil; and mineral oils, such as solvent-treated or acid-treated mineral oils of the paraffinic, naphthenic or mixed paraffinic-naphthenic types. Also useful are oils of lubricating viscosity derived from coal or shale.

Many synthetic lubricants are known in the art and these are useful as a base lubricating oil for lubricating compositions containing the subject additives. Surveys of synthetic lubricants are contained in the publications, SYNTHETIC LUBRICANTS by R. C. Gunderson and A. W. Hart, published by Reinhold (N.Y., 1962), LUBRICATION AND LUBRICANTS, E. R. Braithwaite, ed., published by Elseiver Publishing Co., (N.Y., 1967), Chapter 4, pages 166 through 196, "Synthetic Lubricants", and SYNTHETIC LUBRICANTS by M. W. Ranney, published by Noyes Data Corp., (Park Ridge, N.J., 1972). These publications are incorporated herein by reference to establish the state of the art in regard to identifying both general and specific types of synthetic lubricants which can be used in conjunction with the additive of the present invention.

Thus, useful synthetic lubricating base oils include hydrocarbon oils derived from the polymerization or copolymerization of olefins, such as polypropylene, polyisobutylene and propylene-isobutylene copolymers; and the halohydrocarbon oils, such as chlorinated polybutylene. Other useful synthetic base oils include those based upon alkyl benzenes, such as dodecylbenzene, tetra-decylbenzene, and those based upon polyphenyls, such as biphenyls and terphenyls.

Another known class of synthetic oils useful as base oils for the subject lubricant compositions are those based upon alkylene oxide polymers and interpolymers, and those oils obtained by the modification of the terminal hydroxy groups of these polymers, (i.e., by the esterification or etherification of the hydroxy groups). Thus, useful base oils are obtained from polymerized ethylene oxide or propylene oxide or from the copolymers of ethylene oxide and propylene oxide. Useful oils include the alkyl and aryl ethers of the polymerized alkylene oxides, such as methylpolyisopropylene glycol ether, diphenyl ether of polyethylene glycol and diethyl ether of propylene glycol. Another useful series of synthetic base oils is derived from the esterification of the terminal hydroxy group of the polymerized alkylene oxides with mono- or polycarboxylic acids. Exemplary of this series is the acetic acid esters or mixed $C_3$-$C_8$ fatty acid esters of the $C_{13}$Oxo acid diester of tetraethylene glycol.

Another suitable class of synthetic lubricating oil comprise the esters of dicarboxylic acids, such as phthalic acid, succinic acid, oleic acid, azelaic acid, suberic acid, sebacic acid, with a variety of alcohols. Specific examples of these esters include dibutyl adipate, di(2-ethylhexyl)-sebacate and the like. Complex esters of saturated fatty acids and a dihydroxy compound, such as 3-hydroxy-2,2-dimethylpropyl 2,2-dimethylhydracrylate (U.S. Pat. No. 3,759,862), are also useful. Silicone based oils such as polyalkyl-, polyaryl-, polyalkoxy-, or polyaryloxy-siloxane oils and the silicate oils, i.e., tetraethyl silicate, comprise another useful class of synthetic lubricants. Other synthetic lubricating oils include liquid esters of phosphorus-containing acid, such as tricresyl phosphate, polymerized tetrahydrofurans, and the like.

Unrefined, refined and re-refined oils of the type described above are useful as base oil for the preparation of lubricant compositions of the present invention. Unrefined oils are those obtained directly form a natural or synthetic source without further purification or treatment. For example, a shale oil obtained directly from retorting operations, a petroleum oil obtained directly from distillation, or an ester oil obtained directly from an esterification process, and used without further treatment are unrefined oils. Refined oils are similar to the unrefined oils, except they have been further treated in one or more purification steps, to improve one or more properties. Many such purification techniques are known in the art, such as solvent extraction, acid or base extraction, filtration, percolation, etc. Rerefined oils are obtained by a variety of processes similar to those used to obtain refined oils. The rerefined oils are also known as reclaimed or reprocessed oils and have been treated by additional techniques directed to the removal of spent additives and oil breakdown products.

The subject additive can be used alone or in combination with other lubricant additives known in the prior art. A brief survey of conventional additives for lubricating compositions is contained in the publications, LUBRICANT ADDITIVES, by C. V. Smalheer and R. Kennedy Smith, published by the Lezius-Hiles Co., Cleveland, Ohio (1967) and LUBRICANT ADDITIVES, by M. W. Ranney, published by Noyes Data Corp., Park Ridge, N.J. (1973). These publications are incorporated herein by reference to establish the state of the art in regard to identifying both general and specific types of other additives which can be used in conjunction with the additives of the present invention.

In general, these additional additives include detergents of the ash-containing type, ashless dispersants, viscosity index improvers, pour point depressants, antifoam agents, extreme pressure agents, anti-wear agents, rustinhibiting agents, oxidation inhibitors and corrosion inhibitors.

The ash-containing detergents are the well known neutral basic alkali or alkaline earth metal salts of sulfonic acids, carboxylic acids or organo-phosphorus-containing acids. The most commonly used salts of these acids are the sodium, potassium, lithium, calcium, magnesium, strontium and barium salts. The calcium and barium salts are used more extensively than the others. The "basic salts" are those metal salts known to the art wherein the metal is present in a stoichiometrically large amount than that necessary to neutralize the acid. The calcium- and barium-overbased petrosulfonic acids are typical examples of such basic salts.

The extreme pressure agents, corrosion-inhibiting agents and oxidation-inhibiting agents are exemplified by chlorinated aliphatic hydrocarbons, such as chlorinated wax; organic sulfides and polysulfides, such as benzyl-disulfide, bis-(chlorobenzyl)disulfide, dibutyl tetrasulfide, sulfurized sperm oil, sulfurized methyl ester of oleic acid, sulfurized alkylphenol, sulfurized dipentene, sulfurized terpene, and sulfurized Diels-Alder adducts; phosphosulfurized hydrocarbons, such as the reaction product of phosphorus sulfide with turpentine or methyloleate; phosphorus esters such as the dihydrocarbon and trihydrocarbon phosphites, i.e., dibutyl phosphite, diheptyl phosphite, dicyclohexyl phosphite, pentylphenyl phosphite, dipentylphenyl phosphite, tridecyl phosphite, distearyl phosphite, and polypropylene substituted phenol phosphite; metal thiocarbamates, such as zinc dioctyldithiocarbamate and barium heptylphenol dithiocarbamate; and Group II metal salts of phosphorodithioic acid, such as zinc dicyclohexyl phosphorodithioate, and the zinc salts of a phosphorodithioic acid.

The ashless detergents or dispersants are a well known class of lubricant additives and are extensively discussed and exemplified in the above-cited publications by Smalheer et al and Ranney and the references cited therein. Particularly useful types of ashless dispersants are based upon the reaction products of hydrocarbon-substituted succinic acid compounds and polyamines or polyhydric alcohols. These reaction products may be post-treated with materials, such as alkylene oxides, carboxylic acids, boron compounds, carbon disulfide and alkenyl cyanides to produce further useful ashless dispersants.

Pour point depressing agents are illustrated by the polymers of ethylene, propylene, isobutylene, and poly(alkyl methacrylate). Anti-foam agents include polymeric alkyl siloxanes, poly(alkyl methacrylates), terpolymers of diacetone acrylamide and alkyl acrylates or methacrylates, and the condensation products of alkyl phenols with formaldehyde and an amine. Additional viscosity index improvers include polymerized and copolymerized alkyl methacrylates and polyisobutylenes.

When additional additives are formulated in lubricating compositions containing the subject additive, they are used in concentrations sufficient to provide in the final lubricating composition concentrations in which they are normally employed in the art. Thus, they generally are used in a concentration of from about 0.001 up to about 25% by weight of total lubricating composition, depending of course, upon the nature of the additive and the nature of the lubricant composition. For example, ashless dispersants can be employed in amounts from about 0.1 to about 10% and metal-containing detergents can be employed in amounts from about 0.1 to about 20% by weight. Other additives, such as pour point depressants, extreme pressure additives, viscosity index improving agents, anti-foaming agents, and the like, are normally employed in amounts of from about 0.001 to about 10% by weight of the total composition, depending upon the nature and purpose of the particular additive.

The following lubricant compositions exemplify the incorporation of the additives of the present invention into these type compositions.

EXAMPLE A

A lubricating composition suitable for use as an automatic transmission fluid is prepared using a 120 neutral mineral base oil, 3.25% by volume of an oil based mixture of a viscosity index improver derived from mixed esters of a styrene maleic acid interpolymer as disclosed in U.S. Pat. No. 3,702,300 and the reaction product, in a ratio of 4:3 equivalents, of a polyisobutenyl succinic anhydride and ethylene polyamine, 5% by volume of an additive concentrate, and 1% by volume of a 2′-ethylhexyl ester of the 3,5-lactone prepared according to the general procedure of Example 1. The additive concentrate which is used gives the following concentration of additives to the final lubricating composition:

- 2.9% by volume of a dispersant which is the reaction product (1:1) equivalents of polyisobutyenyl succinic anhydride and tetraethylene pentamine prepared according to the procedure of U.S. Pat. No. 3,172,892;
- 0.9% by volume of a corrosion inhibitor which is the reaction product of polyisobutenyl succinic anhydride, tetraethylene pentamine and boric acid as described in U.S. Pat. No. 3,254,025;
- 0.2% by volume of a diphenyl amine based oxidation inhibitor;
- 0.1% by volume of a beta-hydroxyalkyl phosphonate friction modifier;
- 0.6% by volume of a zinc isooctyl phosphorodithioate oxidation inhibitor;
- 0.1% by volume of a conventional friction modifier based upon Polyoxyethylene (2) Tallow Amine (Ethomeen T/12);
- 0.04% by volume of a demusifier based upon a polhydroxyalkyl amine; and
- 200 ppm of a conventional silicone based anti-foaming agent.

When the 2′-ethyl hexyl ester of the 3,5-lactone in the above composition is replaced with an equivalent amount of the hexyl ester of 2-methyl 3,5-lactone, or the 2′,4′-dihydroxybutyl ester of 7,7-dimethyl-2,5-lactone, or the diisooctyl ester of 2-propyl-2,3-diacid, or the dicyclohexyl ester of 7,7′-diethyl-2,3-diacid, suitable lubricating compositions are obtained.

EXAMPLE B

A lubricating composition suitable for use as a power transmission fluid is prepared using a 200 neutral mineral lubricating base oil,

- 3% by volume of a conventional acrylate based viscosity index improver; 1% by weight of the decanol ester lactone product of Example 1; 500 ppm of a conventional anti-foaming agent based upon a polymer of 2-ethylhexyl acrylate and ethyl acrylate; and 7.7% by volume of an additive concentrate. The additive concentrate gives the following concentration of additives to the final lubricating composition,
- 3.5% by volume of a calcium overbased sulfonate;
- 3.0% by volume of a zinc isooctyl phosphorodithioate oxidation inhibitor;
- 2.2% by volume of a mixture of sulfurized soybean oil, fatty acids, and olefins as a combination oxidation inhibitor and EP agent;
- 0.25% by volume of a slip agent based upon a commercially available mixture of oleamide and linolamide; and
- 0.75% by volume of a EP agent based upon a sulfurized isobutylene.

When the decanol ester lactone product in the above composition is replaced with an equivalent amount of the 2′-chloroethoxyethyl ester of 7,7′-dimethyl-3,5-lactone, or the 2′-ethylhexyl ester of 2-butyl-2,5-lactone, or the dipentadecyl ester of 1-pentyl-2,3-diacid, or the naphthyl ester of 1-propyl-2,5-lactone, suitable lubricating compositions are obtained.

EXAMPLE C

A lubricating compositon suitable for use as a hydraulic oil is prepared using a 200 neutral mineral lubricating base oil, 2% by weight of the n-butyl ester lactone product of Example 2, 9% by weight of a zinc methylamyl phosphorodithioate EP agent and oxidation inhibitor and 0.5% by weight of a partial ester (about 5%) of propylene oxide and dodecenyl succinic acid, as a rust inhibitor.

When the n-butyl ester lactone product in the above composition is replaced with an equivalent amount of the benzyl ester of 1-pentyl-3,5-lactone, or the 3′-hydroxypropyl ester of 2-methyl-5-ethyl-2,5-lactone, or the phenyl ester of 6-heptyl-3,5-lactone, or the hydroxyethyl ethyl diester of 3-butyl-7-propyl-2,3-diacid, or the phenethyl ester of 2,5-lactone, suitable lubricating compositions are obtained.

EXAMPLE D

A lubricating composition suitable for use as an automatic transmission fluid is prepared using a 120 netural mineral lubricating base oil, 3.25% by volume of a viscosity index improver derived from mixed esters of a styrene-maleic acid interpolymer as disclosed in U.S. Pat. No. 3,702,300; 1% by volume of the n-butyl ester 3,5-lactone reaction product of Example 2, and 5% by volume of the additive concentrate of Example A. This additive concentrate gives the same concentration of additives to the final lubricating composition as given in Example A.

In the above examples, as well as in the specification and claims, all percentages are expressed as percentage by weight, and all parts are expressed as parts by weight, unless otherwise indicated. Likewise, all temperatures, are expressed in degrees centigrade (°C.) unless otherwise indicated. Also, the singular forms of "a", "an " and "the" include the plural unless the context clearly dictates otherwise.

What is claimed is:

1. A lubricating composition comprising a major amount of lubricating oil and a minor, effective, amount of an additive selected from the group consisting of those represented by the formulae:

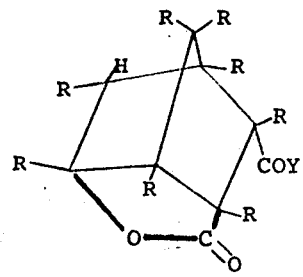

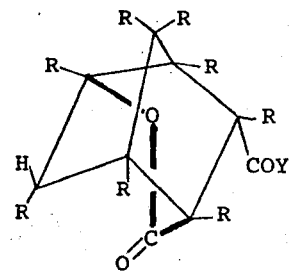

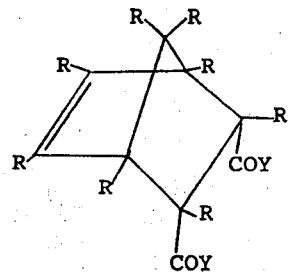

When the n-butyl ester of the 3,5-lactone in the above composition is replaced with an equivalent amount of the 4'-hydroxybutyl ester of 3-ethyl-7-methyl-3,5-lactone, or the cyclohexyl ester of 2-ethyl-4-propyl-2,5-lactone, or the dipentadecyl ester of 2-propyl-5-ethyl-2,3-diacid or the benzyl methyl diester of 2-ethyl-4-propyl-2,3-diacid, or the cyclohexylmethyl ester of 2-propyl-4-ethyl-3,5-lactone, suitable lubricating compositions are obtained.

EXAMPLE E

A lubricating composition suitable for use as a hydraulic oil is prepared using a 200 neutral mineral lubricating base oil 2% by weight of the mixed primary amyl/isobutyl ester (about 60% isobutyl) ester of the 3,5-lactone prepared according to the general procedure of Example 1; 9% by weight of a zinc methylamyl phosphorodithioate, which is a combination EP agent and oxidation inhibitor, and 0.5% by weight of a rust inhibitor based upon a partial (about 5%) ester of propylene oxide and a dodecenyl succinic acid.

When the amyl/isobutyl ester of the 3,5-lactone in the above composition is replaced with an equivalent amount of the octyldecyl ester of 2-methyl-5-methyl-3,5-lactone, or the eicosyl ester of 3-butyl-7-ethyl-3,5-lactone, or the phenethyl ester of 3,5-lactone, or the butyl ester of 1-pentyl-2,5-lactone, or the di(3'-hydroxybutyl) ester of 6-hexyl-2,3-diacid, suitable lubricating compositions are obtained.

and mixtures thereof, wherein each R is independently selected from the group consisting of hydrogen and lower alkyl, and each Y contains up to twenty-two carbon atoms and is independently selected from the group consisting of hydrocarbon-based oxy radicals and the oxy residue of polyhydric alcohol.

2. The lubricating composition of claim 1, wherein Y is a hydrocarbon-based oxy radical.

3. The lubricating composition of claim 2, wherein R is hydrogen.

4. The lubricating composition of claim 1, wherein Y is an oxy residue of a polyhydric alcohol.

5. The lubricating composition of claim 4, wherein R is hydrogen

6. The lubricating composition of claim 1, wherein R is a lower alkyl.

7. The lubricating composition of claim 6, wherein Y is a hydrocarbon-based oxy radical.

8. The lubricating composition of claim 6, wherein Y is the oxy residue of a polyhydric alcohol.

9. The lubricating composition of claim 6, wherein R is methyl.

10. The lubricating composition of claim 1, wherein Y is an alkoxy group.

11. The lubricating composition of claim 1, wherein R is hydrogen and Y is alkoxy having from about 3 to about 10 carbon atoms.

12. A lubricating composition comprising a major amount of lubricating oil and from about 0.1% to about 10% by weight of an additive selected from the group consisting of those represented by the formulae:

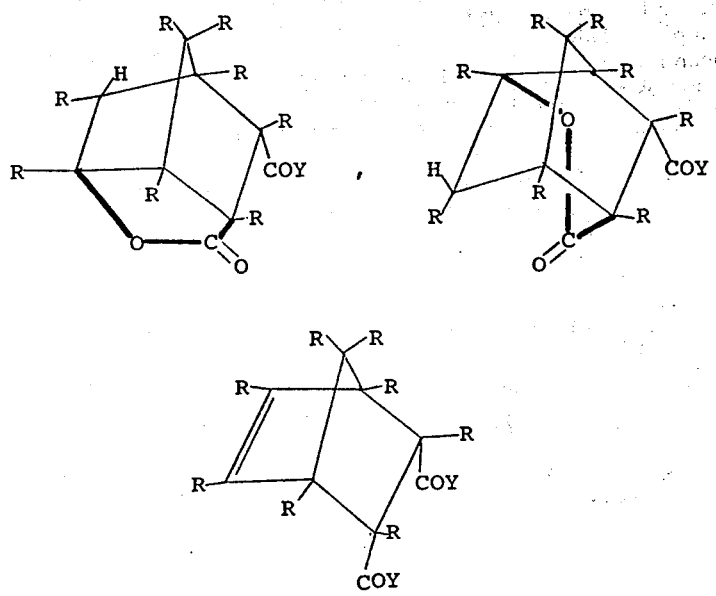

and mixtures thereof, wherein R is hydrogen and Y is an alkoxy group having from about 3 to about 10 carbon atoms.

13. An additive concentrate comprising a substantially inert carrier and from about 20% to about 90% by weight of an additive selected from the group consisting of those represented by the formulae:

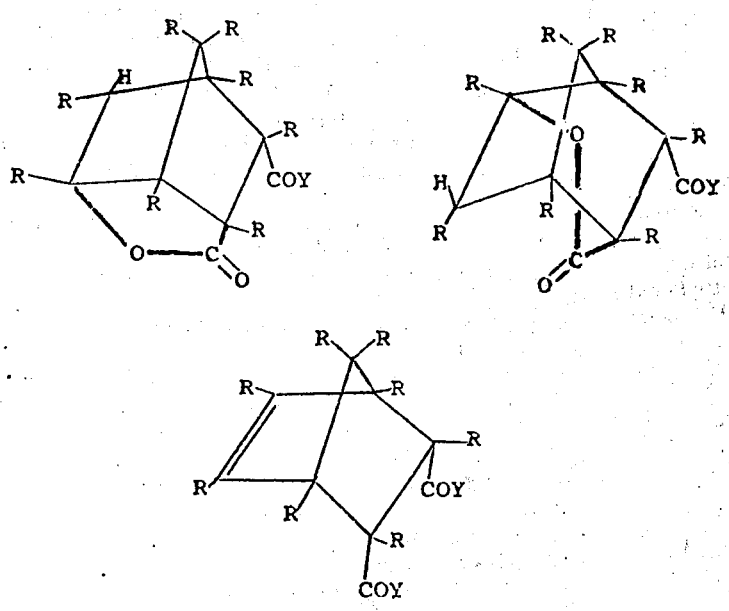

and mixtures thereof, wherein each R is independently selected from the group consisting of hydrogen and lower alkyl, and each Y contains up to 22 carbon atoms and is independently selected from the group consisting of hydrocarbon-based oxy radicals and the oxy residue of a polyhydric alcohol.

14. The additive concentrate of claim 13, wherein Y is a hydrocarbon-based oxy radical and R is hydrogen.

15. The additive concentrate of claim 13 wherein Y is an oxy residue of a polyhydric alcohol and R is hydrogen.

* * * * *